United States Patent [19]

Lubov

[11] 4,023,766

[45] May 17, 1977

[54] STRUCTURAL SUPPORT FOR A CONCRETE FORM

[75] Inventor: Donald S. Lubov, San Jose, Calif.

[73] Assignee: Georight Industries, Inc., San Jose, Calif.

[22] Filed: Nov. 6, 1975

[21] Appl. No.: 629,274

[52] U.S. Cl. ..... 249/48; 40/155; 229/34 HW; 249/134; 249/219 R

[51] Int. Cl.[2] ..... E04G 13/02; E04G 17/14

[58] Field of Search ..... 40/155; 229/14 C, 34 HW; 249/13, 18, 48, 61, 134, 164, 207, 210, 219 R

[56] References Cited

UNITED STATES PATENTS

| | | | |
|---|---|---|---|
| 2,450,110 | 9/1948 | Brooks | 229/34 HW |
| 2,589,045 | 3/1952 | Brooks | 229/34 HW |
| 2,991,533 | 7/1961 | Reid et al. | 249/48 |
| 3,079,061 | 2/1963 | Wojcik | 229/14 C |
| 3,128,725 | 4/1964 | Becker et al. | 249/61 |
| 3,350,049 | 10/1967 | Reiland | 249/48 |
| 3,713,577 | 1/1973 | Skinner | 2;29/34 HW |

FOREIGN PATENTS OR APPLICATIONS

| | | | |
|---|---|---|---|
| 1,240,802 | 7/1971 | United Kingdom | 40/155 |

*Primary Examiner*—Richard B. Lazarus
*Assistant Examiner*—John McQuade
*Attorney, Agent, or Firm*—Lowhurst & Aine

[57] ABSTRACT

A structural form is constructed of a single sheet of material, such as cardboard, which is cut along certain lines and folded to provide a three dimensional configuration. The sheet material is cut to provide tabs each extending from a side of a respective panel portion. The panel portions, when folded, form the outer side walls of an enclosure. The tabs at opposite edges of each panel are folded into the enclosure to form channel members. Every alternate one of the tabs is provided with additional perforations, such that it can also be folded to nest an adjacent tab when all of the tabs are folded inwardly of the side wall panel portions. The tabs are folded such that a first portion thereof, which is secured to its respective panel portion slopes inwardly and toward the center of the enclosure. The remaining portion of each tab is folded to extend from a central area within the enclosure to a respective one of the panel portions. All of the edges of the tabs bear at right angles against the internal surfaces of the panel portions to provide a relatively rigid structure when assembled.

7 Claims, 2 Drawing Figures

STRUCTURAL SUPPORT FOR A CONCRETE FORM

BACKGROUND OF THE INVENTION

Field of the Invention

This invention relates generally to a structural form, and more particularly to such a form which is constructed of sheet material which is folded to provide a relatively rigid structure. Although the structural form of the present invention has particular application as a concrete form, it is to be understood that it may be employed as any form which is intended to support weight or forces imposed thereon.

Prior Art

A variety of forms constructed of a foldable or pliable material, such as cardboard, are available for supporting a mass, such as wet concrete. Such structural forms are available in a variety of shapes for performing a specific function, such as the casting of concrete to a desired shape. In this respect, such presently known forms are limited in their ability to concrete in a variety of shapes, and are generally capable of casting concrete in only one shape. Reference is made, for example, to U.S. Pat. No. 2,296,352 in which a concrete form is disclosed for casting concrete piers. The concrete form disclosed in that patent is limited to a cylindrical shape. Other cylindrically shaped forms for casting a cylindrical aperture in concrete are disclosed in U.S. Pat. Nos. 2,659,134 and 2,694,847. It can be appreciated that the concrete forms disclosed in the above mentioned patents are limited to only one shape.

A problem which has long existed in the building construction industry is that of casting concrete columns, particularly such columns having a rectangular cross-section. It has been the practice in the past to construct forms for such columns of relatively heavy material, such as wood planks. After the concrete has been poured in such a from and has set, it is usually not possible to salvage the material of the form. Accordingly, it can be appreciated that such forms can be relatively expensive. Also, the construction and fabrication of such forms requires the use of relatively expensive labor.

With the exception of such custom-made forms, no other forms are available for casing concrete columns having a rectangular cross-sectional shape. Of the known prefabricated structural forms which are capable of casting a shape which is other than cylindrical, none are capable of casting a column.

It can be appreciated that the concrete forms dislosed in the above mentioned patents rely entirely upon the shear strength of the sheet material from which they are constructed. Such shear strength is that strength which resists a force exerted in a direction which is orthogonal to the plane of the sheet material. However, the strength of sheet material, such as cardboard, is considerably greater in a direction which is parallel to the plane thereof. This strength is called the axial strength. That is, if a force is exerted at right angles to sheet materal, it will flex, thereby providing relatively little restraint to such a force. However, if such a force is directed against an edge of the sheet material and parallel to the plane thereof, a relatively large force can be supported. Accordingly, it can be appreciated that the axial strength of sheet material, such as cardboard, is considerably greater than the shear strength thereof.

A number of prefabricated structural forms employ the axial strength of sheet material. Representative examples of such forms are disclosed in U.S. Pat. Nos. 2,101,019; 2,775,019; 3,148,444 and 3,358,960. However, the structural forms disclosed in these patents are not capable of casting a concrete column, but are limited to casting a void in a concrete slab. Accordingly, there is no known structural form presently available for casing a concrete column which employs the axial strength of sheet material to support forces imposed thereon.

SUMMARY OF THE INVENTION

Accordingly, it is an object of the present invention to provide a structural form which is constructed of a relatively inexpensive material, such as cardboard, such that it may be discarded after a single use if desired and still be economically feasible.

Another object of the present invention is to provide a structural form which can be employed for casting concrete columns.

Still another object of the present invention is to provide a structural form which is so constructed that it may be shipped in flat, unfolded state, but may be quickly and conveniently assembled at a construction site.

A further object of the present invention is to provide a structural form which is capable of supporting both externally and internally directed forces exerted thereon.

These and other objects of the present invention are attained by a structural form which is constructed of a single sheet of material, such as cardboard, which can be cut and folded to provide both internal and external load supportive surfaces. The sheet material is cut and folded to provide a plurality of panels which are joined in edge-to-edge succession to form an enclosure having two open ends, with tabs extending from the edges of the panels at the open ends of the enclosure in a manner similar to the well known cardboard box. The tabs, however, are also folded along certain fold lines, such that a first portion of each extends at an acute angle with respect to the panel to which it is attached and toward a center portion of the enclosure. The remaining portion of each tab is folded to bear against an inner surface of each of the outer panels. Alternate ones of the tabs also include additional perforations and fold lines which permit an adjacent folded tab to be nested therein. The tabs, therefore, form internal load supportive surfaces.

The invention, however, as well as other objects, features and advantages thereof will be more fully realized and understood from the following detailed description, when taken in conjunction with the accompanying drawings, wherein:

DETAILED DESCRIPTION OF THE PREFERRED EMBODIMENT

Figure 1:
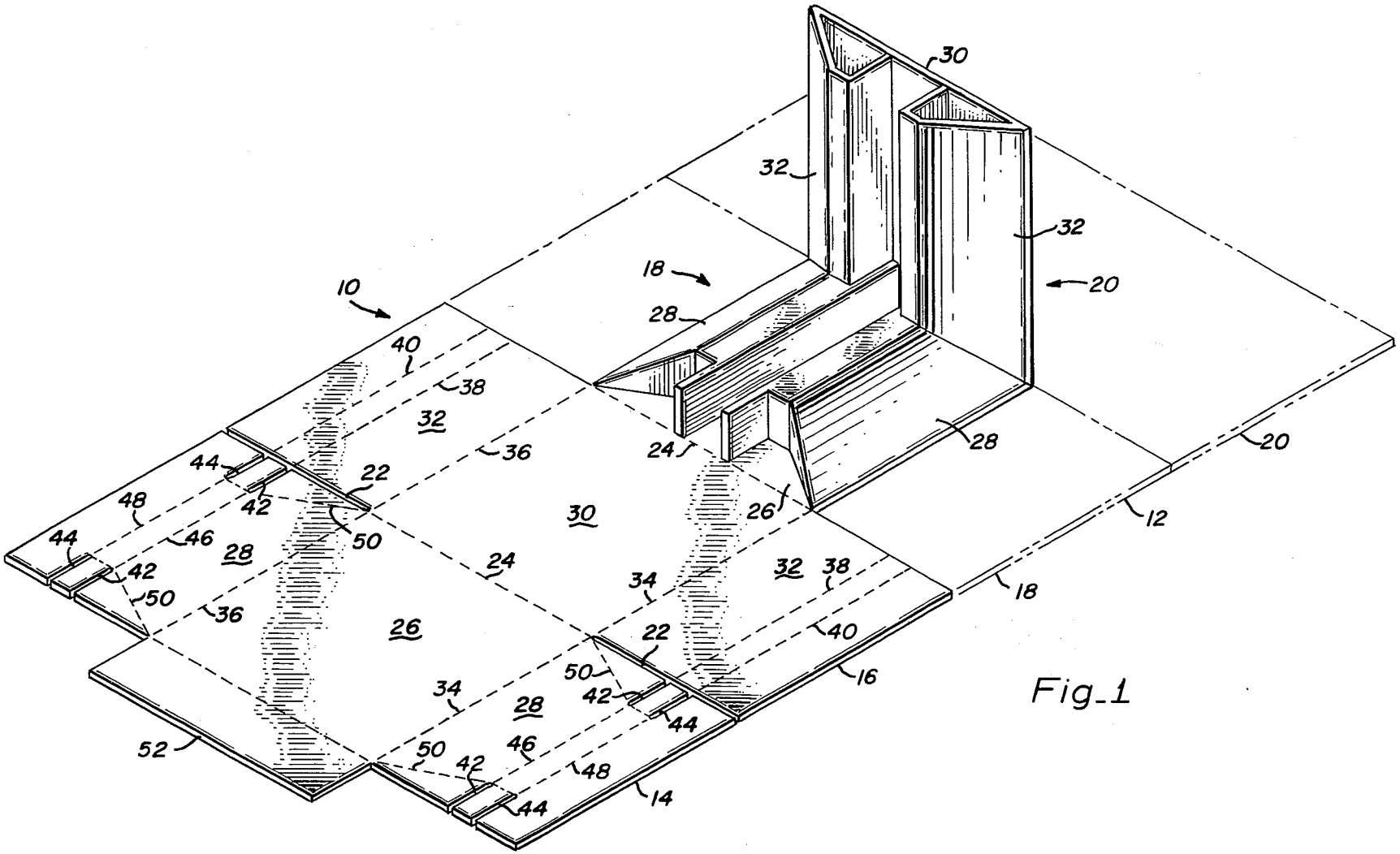
FIG. 1 is a view in perspective of a sheet of material which is cut and partially folded to provide a structural form constructed in accordance with the principles of the present invention.

With reference to FIG. 1, there is shown a sheet of material, such as cardboard, which is generally designated with the reference numeral 10. A portion of the sheet material 10 is illustrated in FIG. 1 as being in its unfolded state and the remaining portion thereof is illustrated as being folded. The portion which is illustrated as being folded is represented in its unfolded state by the phantom outline which is designated with the reference numeral 12. Accordingly, it can be appreciated that the structural form of the present invention can be fabricated of a single, rectangular sheet of material, and that all of the material of that sheet is employed in constructing, without any material being wasted, the structural form of the present invention.

The sheet material 10, in a preferred form of the present invention, is divided into four separate sections designated with the reference numerals 14, 16, 18 and 20. These sections are partially separated from one another by perforations which extend from opposite edges of the sheet 10 and are designated with the reference numeral 22. Sections 14 and 18 are identical to be another and sections 16 and 20 are identical to one another. Accordingly, sections 14 and 16 have been shown in their unfolded states and sections 18 and 20 have been shown in their folded states. The sections 14-20 are also separated by fold lines 24 which extend between opposite ones of the perforations 22.

Each of the sections 14 and 18 includes a panel portion 26 and a pair of tab portions 28. Also, each of the sections 16 and 20 includes a panel portion 30 and a pair of tab portions 32. The panel portions 26 and 30 are separated from the tab portions 28 and 32, respectively, by a pair of fold lines 34 and 36 which are parallel to opposite edges of the sheet 10. Each of the tab portions 32 include a pair of fold lines 38 and 40 which are parallel to one another and to opposite edges of the sheet 10. When the tabs 32 are folded along fold lines 34, 38 and 40, the edges thereof bear against an inner surface of the panel portion 30 as shown by folded section 30. It can be appreciated that the tabs 32, when folded, form channel members. These channel members are effectively formed by a plurality of panels, the edges of which are defined by the fold lines 34, 38 and 40, the perforations 22, and the edges of the sheet material 10.

Each of the tab portions 28 are provided with a pair of perforations 42 and 44 extending from opposite sides thereof and joined by fold lines 46 and 48 which are parallel to one another and to opposite edges of the sheet 10. Also, fold lines 50 are each provided between the end of a respective one of the perforations 42 and a respective corner of a respective panel portion 26. the fold lines 46 and 48 in the tab portions 28 permit the tab portions 28 to be folded as channel members in the same manner as the tab portions 32 are folded. In addition, however, perforations 42 and 44 and fold lines 50 permit the ends of the channel members formed by the tab portions 28 to be folded to provide recesses therein for receiving and nesting respective ends of the channel members formed by the tab portions 32. In addition, a tab 52 is provided at one end of the sheet 10 for being received between the folded ends of the tab portions 32 and the panel portion 30 to hold the entire assembly together.

From FIG. 1, it can be appreciated that the panel members 26 and 30 are joined in edge-to edge succession to form an enclosure having two open ends. The tab portions 28 and 32 can be folded to form channel members internally of the enclosure. All of the edges of the tab portions 28 and 32 which correspond to the opposite edges of the sheet 10 bear against an inner surface of a respective one of the panel portions 26 and 30 when the structural form is fully assembled. Also, alternate ones of the channel members nest in respective recesses in the ends of adjacent channel members, thereby providing a relatively rigid structural form which is capable of supporting forces imposed on the panel portions 26 and 30. In addition, the structural form of the present invention is capable of supporting forces which are imposed internally of the enclosure against the folded tab portions 28 and 32. This capability of the structural form of the present invention when combined with an elongated insert; permits it to be employed as a concrete form for pouring concrete columns, for example. The concrete column takes the shape of the inner sides of the insert, which sides are held ridid by the tab portions of the structure described above.

Figure 2:
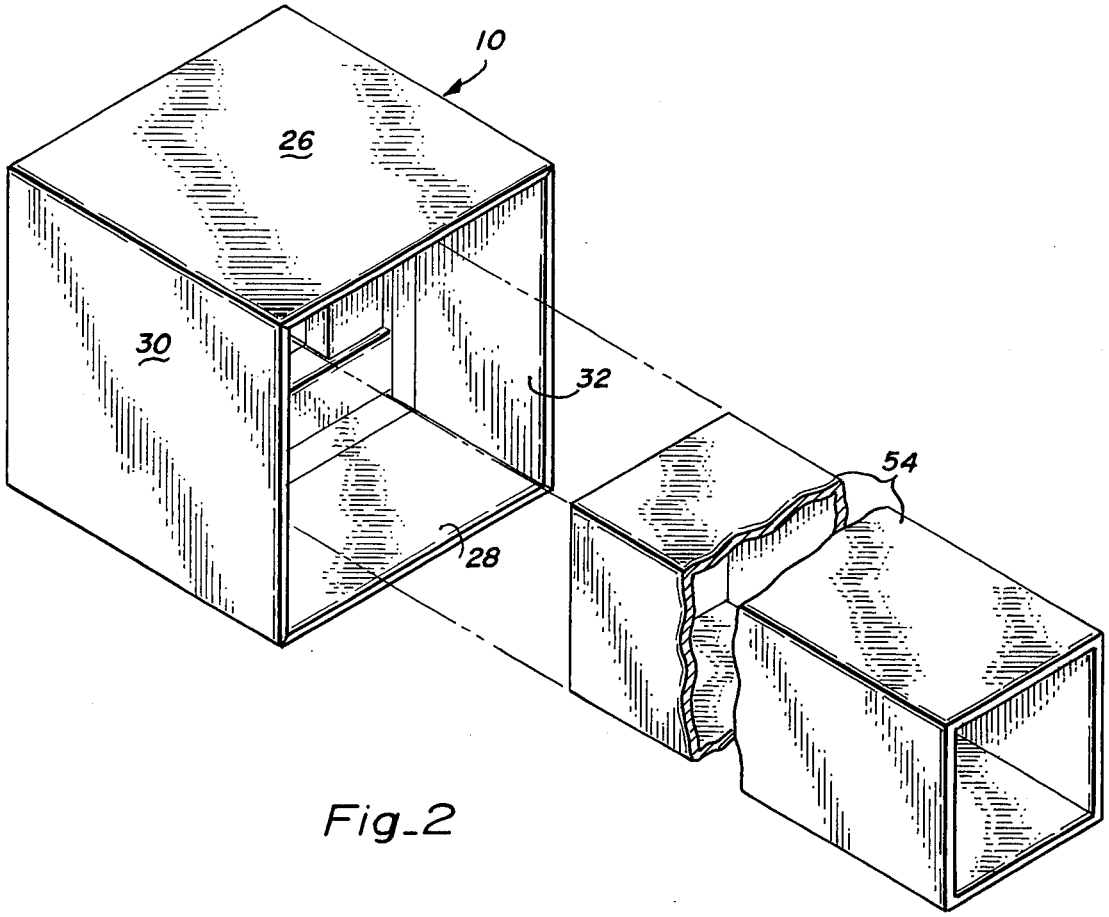
FIG. 2 is a view in perspective, partially broken away, of a structural form constructed in accordance with the principles of the present invention.

The structural form shown in FIG. 1 is illustrated in its assembled state in FIG. 2. An insert 54 in the form of an elongated member is provided for joining adjacent ones of the structural forms of the present invention together. The insert 54 may be formed of a sheet of cardboard material, for example, which has an outer periphery corresponding to the inner periphery of the structural form. By stacking a number of the structral forms, one on top of the other, and joining them by a plurality of the inserts 54, a concrete form is provided which is suitable for pouring a concrete column the sides of which are formed by the inner periphery of the insert 54.

It can be appreciated that a number of changes can be made to the structural form illustrated in FIGS. 1 and 2. Although the structural form has been shown in FIGS. 1 and 2 as being cubical, it is to be understood that its dimensions can be changed to provide any desired rectangular shape. Furthermore, the structural form of the present invention can be employed as any type of structural form, such as a piece of furniture or as a stand for supporting a weight thereon. Furthermore, various types of clamping devices can be employed for holding the panels of structural form of the present invention together. In addition, the assembled structural form of the present invention can be held together by various types of tapes or by a steel band extending around the outer periphery thereof. Accordingly, it can be appreciated that various modifications can be made to the structural form illustrated in FIGS. 1 and 2 without departing from the scope of the appended claims.

I claim:

1. A structural form comprising a. a plurality of first panels joined in edge-to-edge succession to form an enclosure having two open ends; and b. a plurality of channel members at least one for each first panel and each formed of tab portions comprising at least two second panels joined to one another with a first edge of each second panel defining a respective edge of a respective channel member, of said second panels of each channel member being joined at its first edge to a respective edge of a respective one of said first panels which is at an open end of said enclosure, and the other of said second panels of each channel member extending to and having its first edge abutting against an inner surface of the respective one of said first panels;

each of said channel members being approximately equal in length to the length of the respective one of said first panels to which it is joined; and wherein the channel members which are joined to alternate ones of said first panels have a recess at each end thereof for receiving an end of an adjacent one of said channel members, whereby alternate ones of said channel members nest in respective recesses in the ends of adjacent channel members, thereby providing a relatively rigid structural form.

2. The structural form of claim 1, wherein each of said one of said second panels extends at an acute angle with respect to the respective one of said first panels to which it is joined and each of said second panels extends approximately are right angles to the inner surface of the respective one of said first panels.

3. The structural form of claim 1, wherein each of said tab portions further includes a third panel which joins said second panels of the same channel member to one another.

4. The structural form of claim 3, wherein said third panel is approximately parallel to the respective one of said first panels to which the channel member of which it is a part is joined.

5. The structural form of claim 4, wherein said third panels of each of said tab portions define an inner periphery of said structual form, said structural form further comprising an elongated member having an outer periphery conformably shaped to said inner periphery, said elongataed member being received in said enclosure, said elongated member having a length equal at least to the length of said enclosure between the open ends thereof.

6. A structural form comprising a single sheet of foldable and relatively rigid material, said sheet having a first plurality of perforations extending from opposite edges thereof to a pair of first fold lines which are parallel to said opposite edges, the material between said pair of first fold lines defining a plurality of first panels which are joined together in edge-to-edge succession at a plurality of second fold lines which are right angles to said first fold lines, the materials between said first fold lines and respective opposite edges of said sheet defining a plurality of tabs separated from one another by a respective one of said perforations, each of said tabs having a third fold line parallel to said opposite edges, said sheet being folded along said first fold lines and said tabs being folded along said third fold lines such that said opposite edges of said sheet are in abutting relation with a first surface of a respective one of said first panels, said sheet being folded along said second fold lines such that said first panels form an enclosure with said tabs being internal thereto, each of said tabs including a pair of first edges which are at right angles to said opposite edges of said sheet, some of said first edges being formed by said first perforations and the others of said first edges being formed by respective ends of said sheet, alternate ones of said tabs including a second plurality of perforations on each of said pair of first edges each extending at right angles to the respective one of said first edges, each of said alternate ones of said tabs including a plurality of fourth fold lines each extending from an inner end of the respective one of said second plurality of perforations nearest the respective one of said first panels, to the respective one of said first edges at the point at which it joins the respective one of said first panels, such that each end of every other one of said tabs will nest in a respective end of said alternate ones of said tabs.

7. The structural form of claim 6, wherein each of said tabs have a fourth fold line parallel to the respective one of said third fold lines, said tabs being folded along said fourth fold line, such that the area between the respective one of said third fold lines and the respective one of said fourth fold lines defines a panel which is approximately parallel to the respective one of said first panels.

* * * * *